US005759338A

United States Patent [19]

Marchetti

[11] Patent Number: 5,759,338

[45] Date of Patent: Jun. 2, 1998

[54] GUM-COATED PAPER SEALING MACHINE FOR PARALLELEPIPED BOXES WITH TURNED-DOWN FLAPS

[76] Inventor: Augusto Marchetti, Piazza Sicilia,, 7 - 20146 Milano, Italy

[21] Appl. No.: 21,230

[22] Filed: Feb. 23, 1993

[30] Foreign Application Priority Data

Feb. 25, 1992 [IT] Italy ..... MI92 A 0407

[51] Int. Cl.[6] ..... B32B 31/00

[52] U.S. Cl. ..... 156/468; 156/475; 156/486

[58] Field of Search ..... 156/468, 475, 156/486

[56] References Cited

U.S. PATENT DOCUMENTS

| | | | |
|---|---|---|---|
| 3,350,255 | 10/1967 | Twigg | 156/475 |
| 4,044,527 | 8/1977 | Ulrich et al. . | |
| 4,061,526 | 12/1977 | Warshaw et al. . | |
| 4,392,911 | 7/1983 | Ulrich et al. . | |
| 4,572,760 | 2/1986 | Marchetti . | |
| 4,642,157 | 2/1987 | Cavanagh | 156/468 |

FOREIGN PATENT DOCUMENTS

| | | | |
|---|---|---|---|
| 177003 | 4/1986 | European Pat. Off. . | |
| 0259241 | 3/1988 | European Pat. Off. | B65B 51/06 |
| 0502275 | 9/1992 | European Pat. Off. | B65B 51/06 |
| 1002173 | 4/1902 | France . | |
| 1454372 | 9/1966 | France . | |
| 2440875 | 6/1980 | France | B65B 51/06 |
| 7205676 | 10/1972 | Netherlands | B65B 51/06 |
| 195803 | 2/1938 | Switzerland | B65H 35/00 |
| 2071606 | 9/1981 | United Kingdom | B65B 51/06 |

*Primary Examiner*—David A. Simmons
*Assistant Examiner*—Paul M. Rivard
*Attorney, Agent, or Firm*—IP Group of Pillsbury Madison & Sutro LLP

[57] ABSTRACT

A machine comprising a supporting base for boxes to be sealed, a mechanism for moving the boxes, a head that can be displaced vertically with respect to the supporting base, and at least one unit for feeding gum-coated paper sections that is removably disposed in a seat of the vertically displaceable head. The feed unit comprises a plurality of individual units that can be taken apart separately. The feed unit includes a unit for supporting a roll of gum-coated paper, a tape control unit, a tape centering unit, a tape feed unit, a contrast unit cooperable with the tape feed unit, a tape shearing unit, a tape moistening unit, and a unit for applying the moistened tape to the box to be sealed.

7 Claims, 10 Drawing Sheets

GUM-COATED PAPER SEALING MACHINE FOR PARALLELEPIPED BOXES WITH TURNED-DOWN FLAPS

DESCRIPTION

The present invention relates to a gum-coated paper sealing machine for parallelepiped boxes with turned-down flaps.

Several machines are known for sealing the top and of the bottom of parallelepiped boxes with turned-down flaps by means of sections of plastic adhesive tape taken from a continuous roll.

Ecological reasons, however, have recently oriented users, and as a consequence manufacturers, toward sealing machines that use suitably moistened gum-coated paper instead of plastic adhesive tape.

Since these are machines that have remained for a long time outside the large packaging market, and have thus not been subjected to particular modernization thrusts, current gum-coated paper sealing machine are quite complicated, bulky and expensive.

The object of the present invention is to produce a gum-coated paper sealing machine that is of simple construction, easy maintenance, low cost and limited size.

According to the invention such object is attained with a machine comprising a supporting base for boxes to be sealed, means for the forward movement of the boxes associated with said supporting base and a head that can be displaced vertically at a variable distance with respect to said supporting base, characterized in that it comprises at least one assembly for feeding gum-coated paper tape sections that is removably inserted in a seat of said vertically displaceable head.

In addition, according to the invention the above-mentioned assembly for feeding gum-coated paper tape sections is characterized in that it is constituted by a plurality of individual units that can be taken apart separately. Such individual units include a unit for supporting a roll of gum-coated paper, a tape control unit, a tape centering unit, a tape feed unit, a contrast unit co-operating with the tape feed unit, a tape shearing unit, a tape moistening unit and a unit for applying the moistened tape to the box to be sealed.

Also according to the invention, the abovementioned tape feed unit can be moved away from the above-mentioned contrast unit so as to uncover a large part of the path of the tape for the purposes of maintenance, prevention and elimination of possible jammings.

These and other features of the present invention shall be made evident by the following detailed description of an embodiment illustrated as a non-limiting example in the enclosed drawings wherein.

Figure 1:
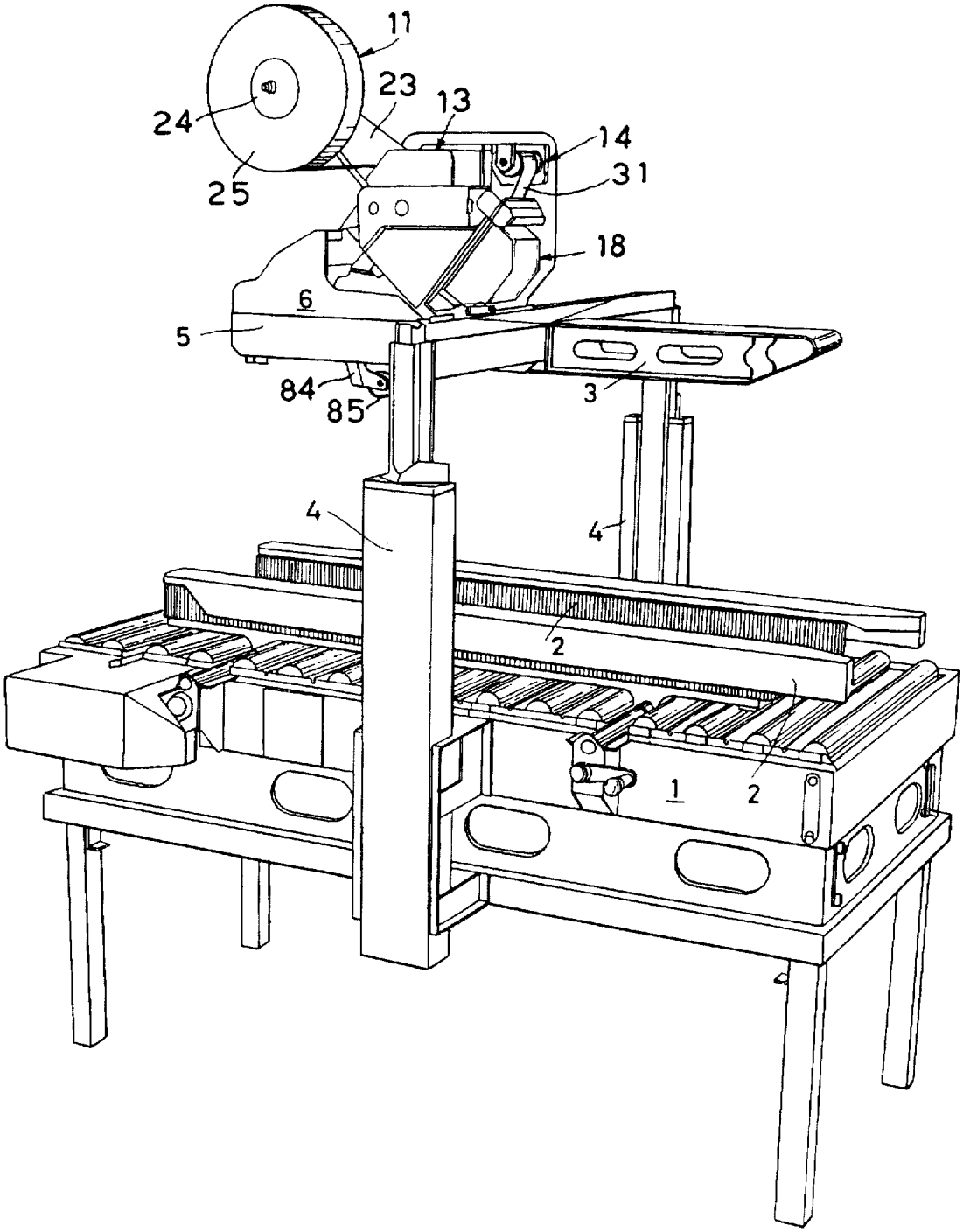
FIG. 1 shows, in a perspective view, the overall appearance of a machine according to the invention.

With reference to FIG. 1, the machine according to the invention comprises a supporting base 1 that defines a supporting face with rollers for the boxes to be sealed, a pair of lateral belts 2 disposed above said supporting base and that can be moved toward one another so as to engage with opposite sies of the boxes for forward movement of said boxes along said supporting base, and a head 3 that can be moved vertically along lateral columns 4 so as to arrange themselves at a variable distance from said supporting base to allow a passing box to be sealed between the head itself and the boxes' supporting face with rollers.

Figure 2:
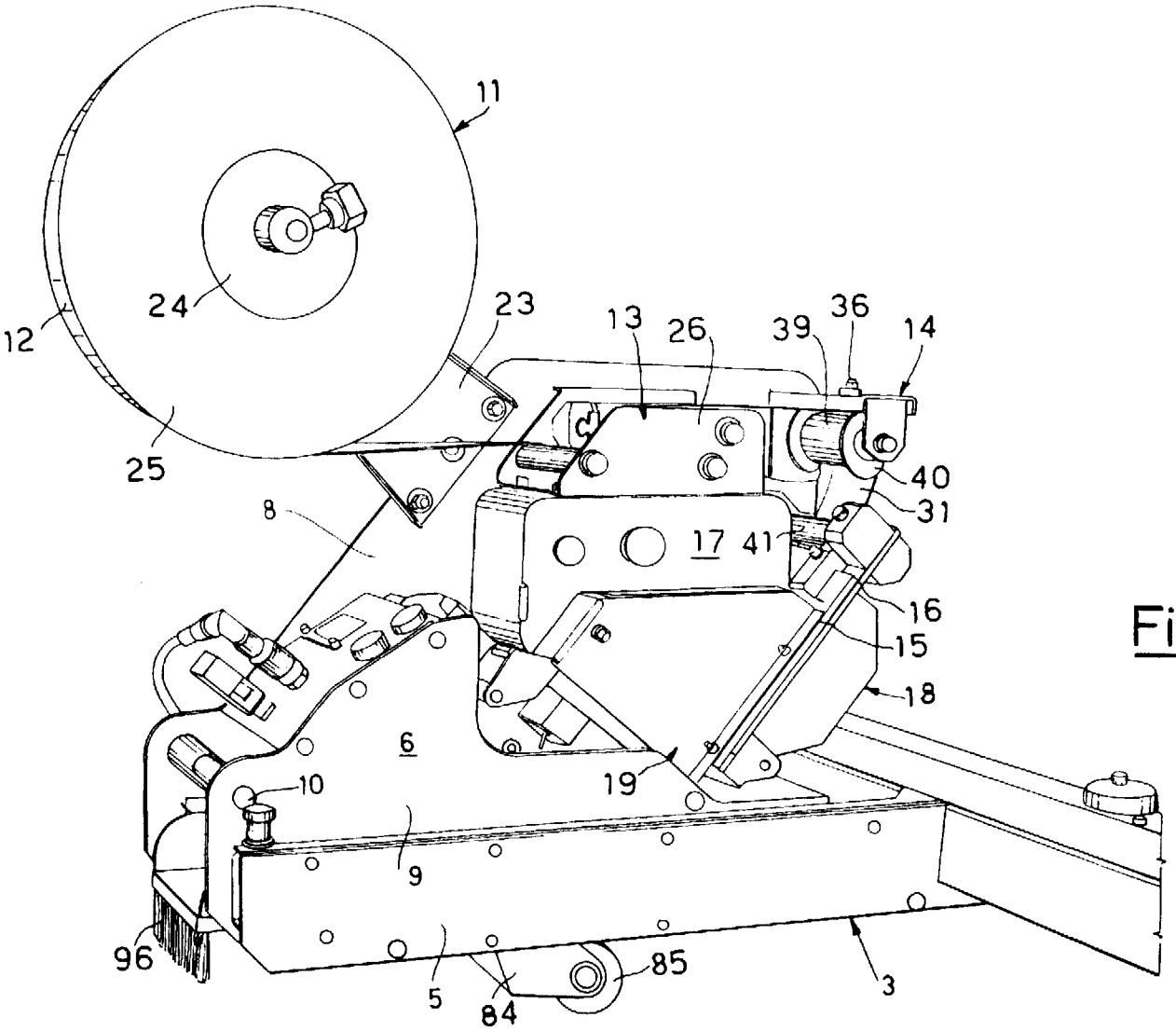
FIG. 2 shows, in a perspective view, an enlarged detail of the head of the machine with the corresponding gum-coated paper tape feed assembly.
Figure 3:
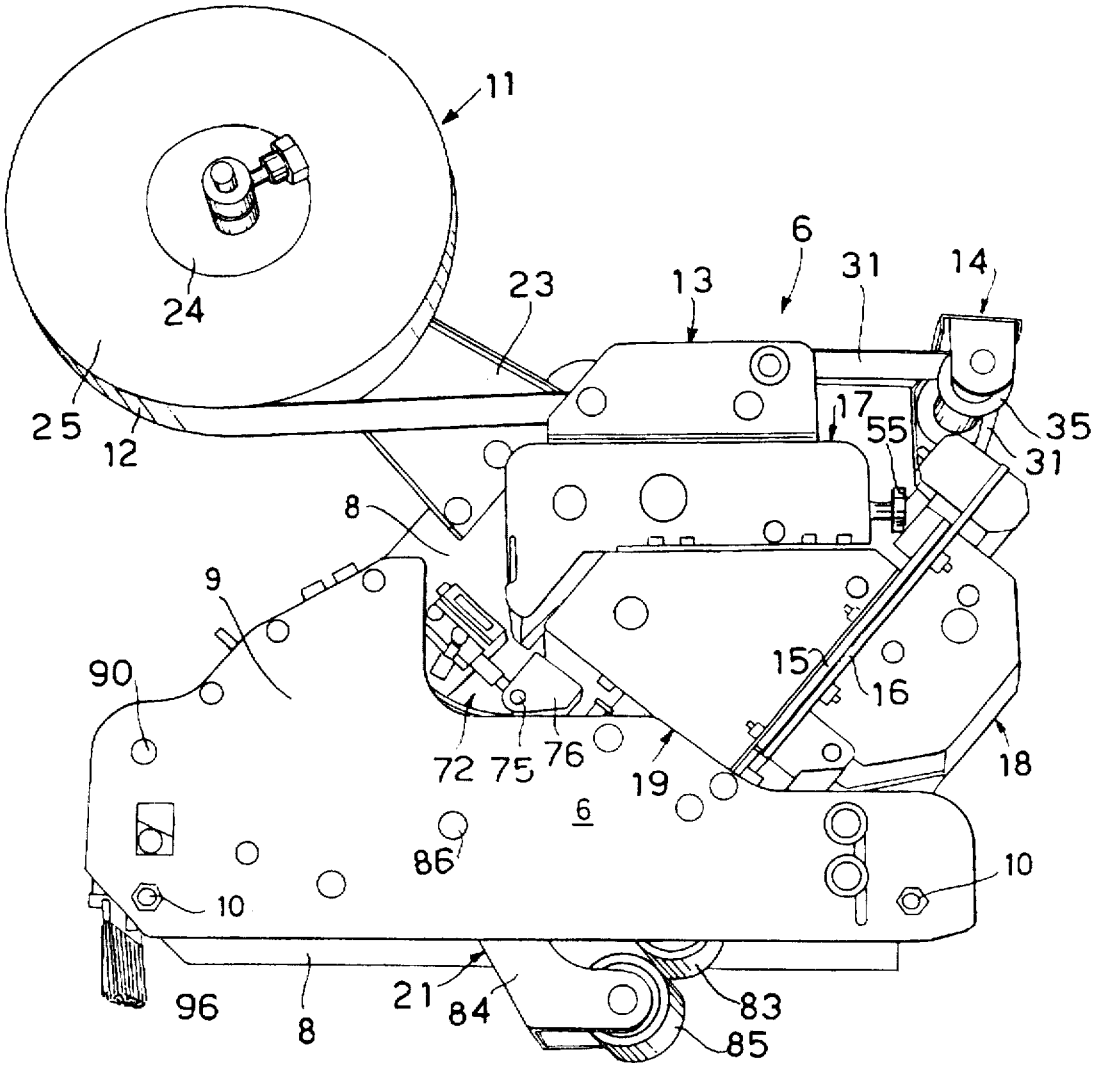
FIG. 3 shows a lateral view of the enlarged detail of the tape feed assembly only.
Figure 4:
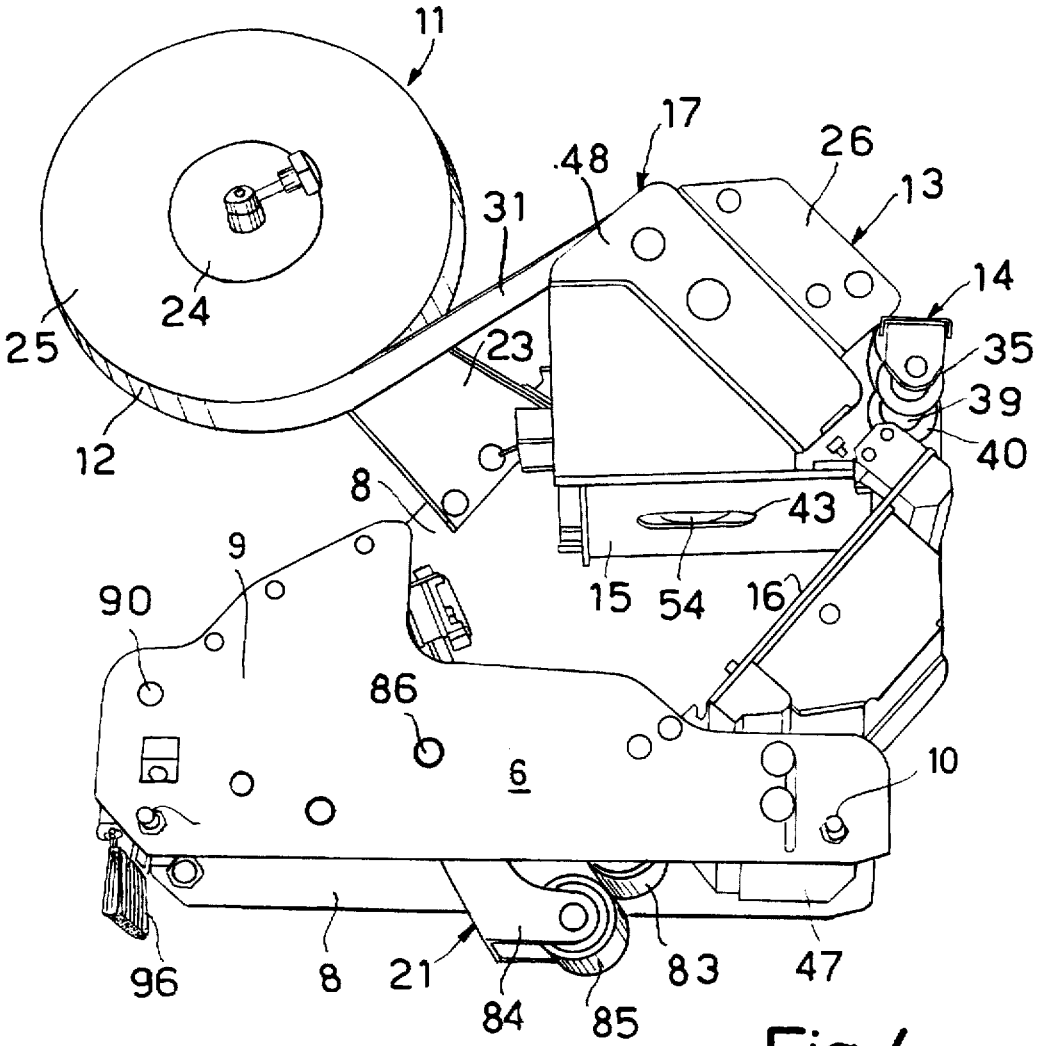
FIG. 4 shows the tape feed assembly in a perspective view in the position where it allows access to the path of the gum-coated paper tape.

In appropriate seats of the supporting base 1 and of the head 3 (in the latter case between a pair of overhanging arms 5, as shown in FIG. 2) there are removably housed respective feed assemblies 6 of sections of gum-coated paper tape from a respective roll 12.

As shown in FIGS. 2–8, each feed assembly 6 is constituted essentially by a plurality of individual units that can be taken apart separately and removably fastened to a lateral supporting shoulder 8, to which there corresponds on the opposite side a lower lateral containment shoulder 9, the two shoulders being provided with small lateral protrusions 10 (FIGS. 2–4) that can be inserted and locked, in a way known in itself, in the two overhanging arms 5 of the head 3 or in corresponding supports obtained in the supporting base 1 for the consequent loose clamping of the tape feed assembly in the operating position (FIGS. 1 and 2).

Figure 5:
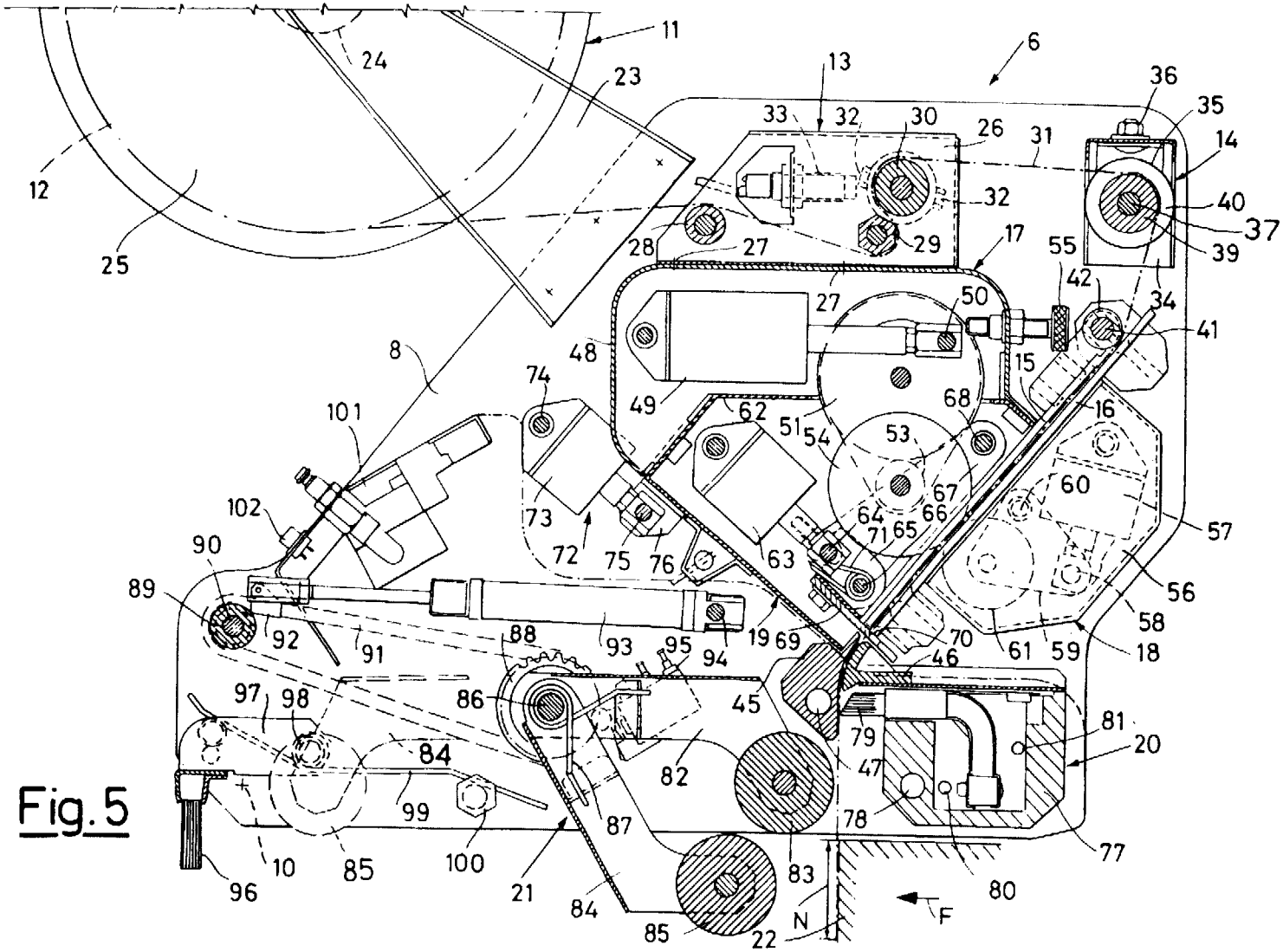
FIG. 5 shows the above-mentioned tape feed assembly in an axial cross-section.

More particularly, each tape feed assembly 6 comprises a supporting unit 11 for a roll of gum-coated paper tape 12 (having, as known, a small layer of glue applied to one of its faces), a unit 13 for controlling the tape unwound from the roll 12, a centering unit 14, a pair of co-operating plates 15 and 16 for the guidance and sliding movement of the tape, a feed unit for the tape 17 and a contrast unit 18 associated with the two plates 15 and 16, respectively, for determining the intermittent forward movement of the tape in relation to the machine's operating cycle, a shearing unit 19 to separate sections of the tape of a predetermined length from the continuous tape taken from the roll 12, a moistening unit 20 for moistening the face provided with glue of the paper tape, and an application unit 21 suitable for executing the application of the section of tape separated and moistened onto the box to be sealed, indicated by numeral 22 in FIG. 5.

Figure 9:
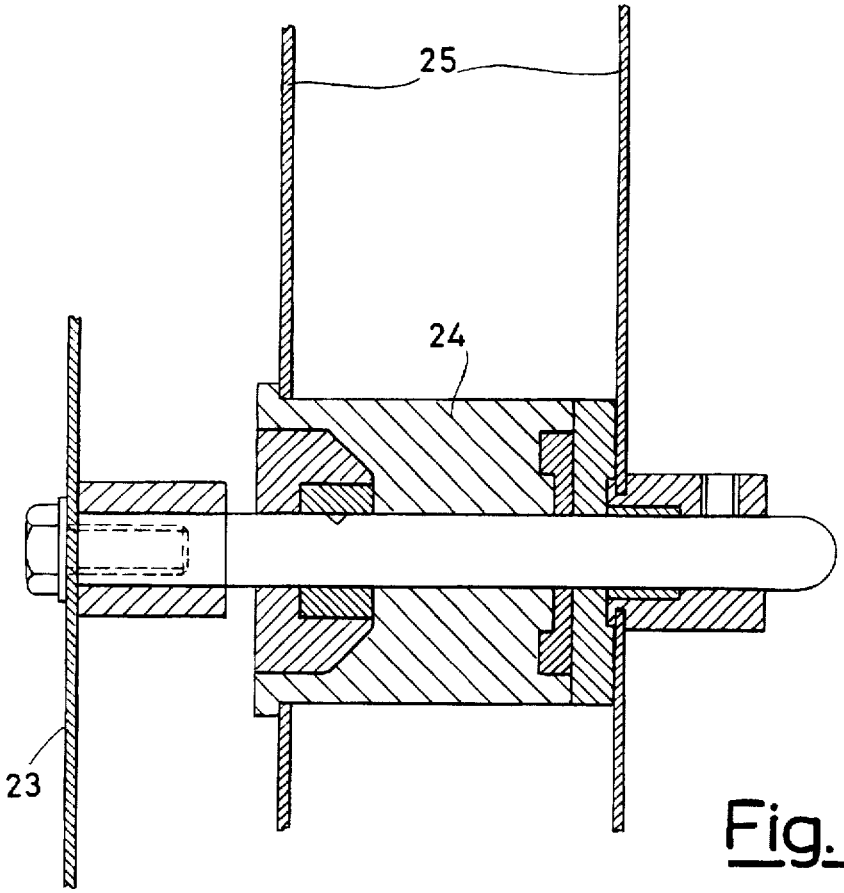
FIGS. 9–12 show construction details of some of the units constituting the above-mentioned tape feed assembly.

As shown more clearly in FIG. 9, the supporting unit 11 consists of an arm 23 fastened to the lateral shoulder 8, a rotating roll-holding roller 24 and of a pair fixed plates 25 for the lateral containment and a braking action, the plates having a diameter substantially equal to that of the paper roll destined to be received between them. The paper roll 12 is mounted on the roller 24 between the two plates 25 so that, as it unwinds, it turns the face provided with glue toward the inside of the roll, so that the same face is then turned toward the moistening unit 20 and toward the front of the box moving forward (arrow F in FIG. 5).

The control unit 13, comprises a box-like casing 26 with a substantially U-shaped cross-section, that is separately fastened to the corresponding casing of the underlying feed unit 17 through nut and screw couplings 27 that can easily be loosened.

Inside said casing there is fastened a series of rollers 28, 29, 30, of which the roller 28 acts simply as the transmission roller for the tape 31 taken from the roll 12. The roller 29 can have a polygonal shape so as to obtain a degree of yield of the paper material of the tape 31, especially when the roll 12 has a small diameter, or otherwise is round, and the roller 30, that co-operates with the roller 29 and on which two metal masses 32 are applied, rotatingly generates impulses detected by an inductive proximity sensor 33 that transmits them to an electronic control unit (not shown) for the detection and determination of the quantity of tape taken.

Figure 10:
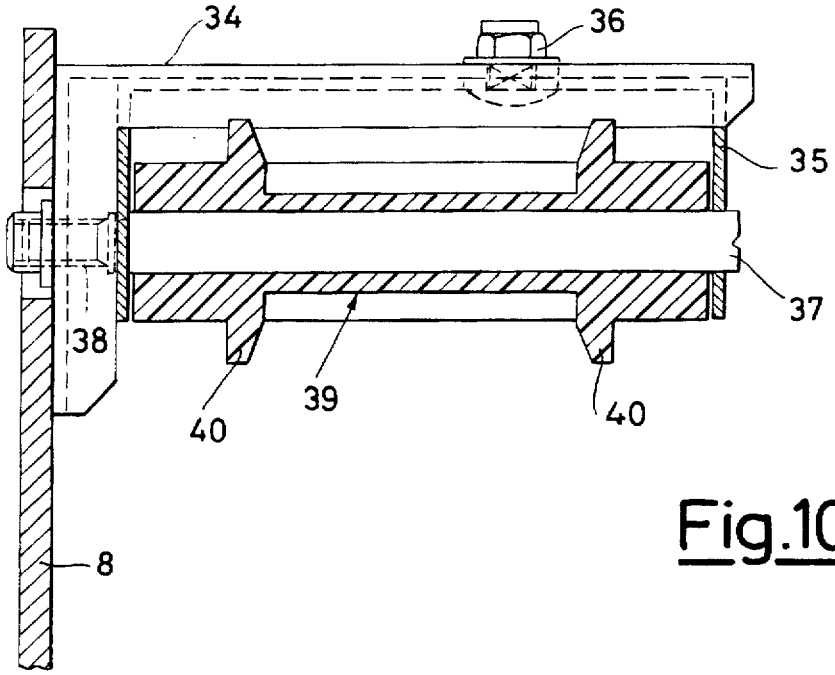

The centering unit 14, whose construction details can be seen more clearly in FIG. 10, comprises an external support 34 fastened to the lateral shoulder 8 and an internal support 35 fastened to the first in an adjustable manner via bolt 36 and also fastened to the shoulder 8 via pin 37 having a threaded extremity 38, on which there is rotatably mounted an idle roller 39 provided with lateral shoulders 40 for holding and guiding the tape 31.

When the bolt 36 is loosened and the pin 37 is screwed, the support 35 slides inside the support 34, displacing the roller 39 and thus guiding the gum-coated paper tape in the desired position.

The tape can be slightly off center with respect to the feed unit, but it must be centered with respect to the passage of the box in the machine.

The pair of co-operating plates 15, 16 consists of a fixed lower plate 16 separatably fastened to the shoulder 8 and of an upper movable plate 15 that can be rotated on a horizontal pin 41, that is separatably fastened to the shoulder 8, and that also acts as the support for an idle roller 42 for the transmission of the tape 31. The two plates 15 and 16 have respective central openings 43, 44, shown in FIGS. 11 and 12, whose functions shall be made more clear later in connection with the description of the feed and contrast units 17 and 18. They are also inclined at an angle of about 40 degrees so as to allow an easier sliding movement of the gum-coated paper tape.

Two chutes 45 and 46 at the exit of the two plates (FIG. 5) displace the tape at an angle so that it faces the moistening unit 20 and the direction of translation of the box at right angles.

This operation also confers a degree of rigidity to the gum-coated paper tape. On the chute 45 it is possible to fit an electrical resistance 47 to heat the gum-coated paper tape when it is moistened, thus facilitating the activation of the glue mass.

The tape feed unit 17 comprises a metal box-like casing 48 fastened through nuts and screws to a correspondign casing of the underlying shearing unit 19. As already said, the casing 26 of the tape control unit 13 is separatably fastened to the casing 48.

Figure 11:
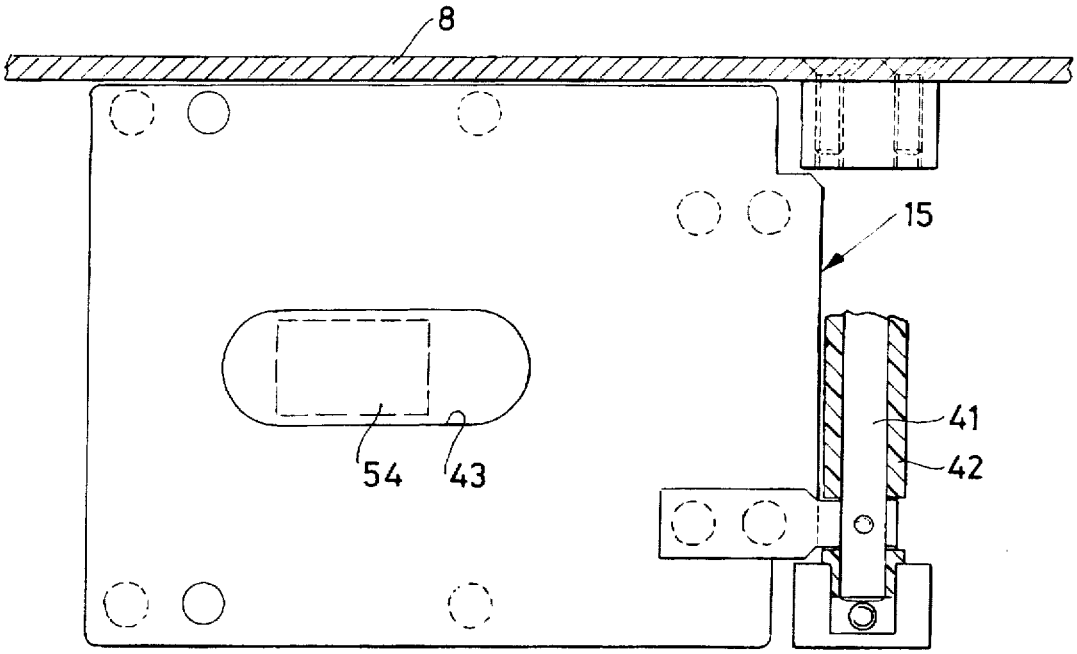
Figure 12:
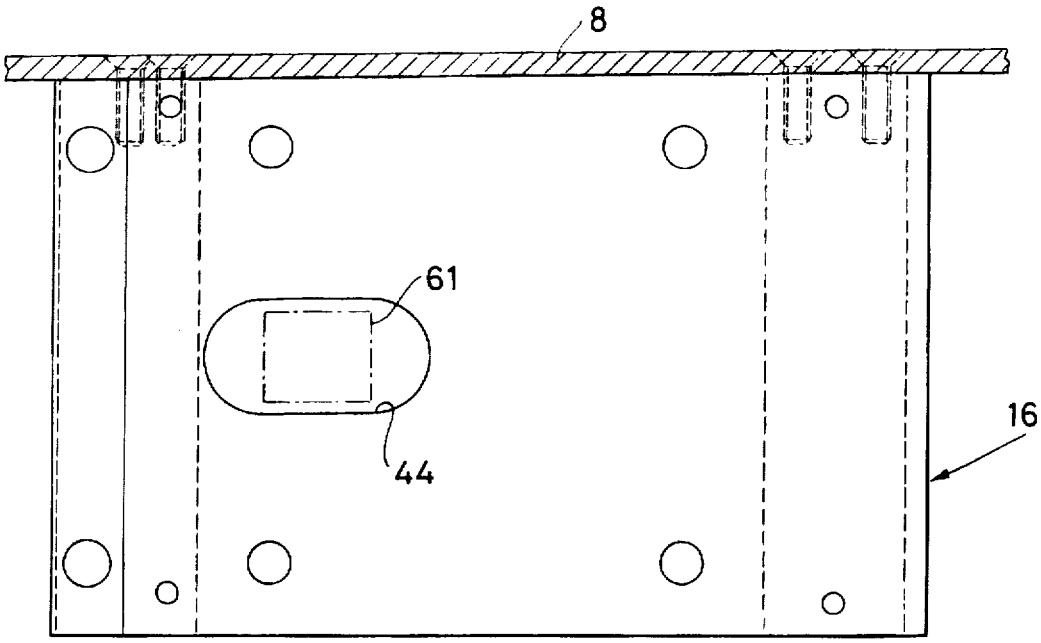

Inside the box-like casing 48 there is twin-action pneumatic cylinder 49, whose stem is connected by an articulated joint to an eccentric pin 50 protruding in the front from a first gear 51 that directly engages with a second gear 53 having a smaller diameter, to which there is fastened concentrically and integrally a wheel 54 in metal alloy that passes through the opening 43 of the plate 15 (FIG. 11).

In this manner the rectilinear movement of the cylinder 49 is transformed in rotary movement of the gear 51, that transmits it to the gear 53 and thus to wheel 54 which, with the help of an idle contrast wheel of the contrast unit 18 (to be described later), imparts to the gum-coated paper tape 31 a downward rectilinear movement along the path identified by the two plates 15 and 16.

An abutment knob screw 55 fastened adjustably to the casing 48 allows the adjustment of the stroke of the cylinder 49, and thus the angular stroke of the wheel 54, and as a consequence the length of the section of tape which, after separation from the rest of the tape 31, shall be applied to the box to be sealed.

The contrast unit 18 comprises a metal box-like casing 56 in which there is housed a pneumatic cylinder 57 with a simple action and elastic return, whose stem is connected by an articulated joint to a pin 58 extending between two bracket levers 59 hinged at 60 on the shoulder 8. On the abovementioned levers 59 there is rotatably mounted a rubber wheel 61 which protrudes through the opening 44 of the plate 16 (FIG. 12) to exert a contrasting force with the metal wheel 54 of the feed unit 17 for the controlled forward movement of the paper tape 31.

The linear movement of the cylinder 57 is transformed in a movement whereby the wheel 61 is brought closer to or further away from the wheel 54, thus allowing the forward movement or otherwise of the gum-coated paper tape in synchronization with the operation of the unit 17.

The tape shearing unit 19 comprises a metal box-like casing 62 to which there is separatably fastened the casing 48 of the tape feed unit 17 and which is in turn separatably fastened to the movable plate 15. Inside the casing 62 there is a simple-action pneumatic cylinder 63, whose stem is connected by an articulated joint to a pin 64 extending between two connecting rods 65 hinged at 66 on a pair of levers 67 hinged at 68 and integrally supporting a shearing blade 69 co-operating with a fixed counterblade 70 under the thrust of a spring 71 acting on the blade-holding levers 67.

Under the action of the cylinder 63 the connecting rods 65 push the blade 69 to shear the gum-coated paper tape 31 with the help of the counterblade 70 against which the blade 69 is pushed by the force of the spring 71.

With the set consisting of the shearing group 19, of the feed group 17, of the movable plate 15 and of the control unit 13 there co-operates a disengagement unit 72 consisting of a pneumatic cylinder 73 hinged at 74 on the shoulder 8 and with a stem connected by an articulated joint at 75 to a bracket 76 fastened to the casing 62 of the shearing unit 19.

The operation of the cylinder 75, suitably timed, allows, after a given predetermined time with no taping cycle, the opening of the tape's path between the two plates 15, 16 (FIG. 4) so as to forestall or in any case to eliminate any tape jammings. Such opening can also be used for purposes of periodic maintenance of the feed unit.

The moistening unit 20 consists of a container 77 with two lateral holes 80 and 81, the first for supplying water and the second for discharging any water overflow.

On the container 77 there is an electrical resistance 78 for heating the moistening water so as to obtain a better activation of the glue mass associated with the gum-coated paper tape 31.

A brush 79 is immersed in the water of the container which by capillarity will bring the water in contact with the gum-coated paper tape against the chute 45.

Figure 6:
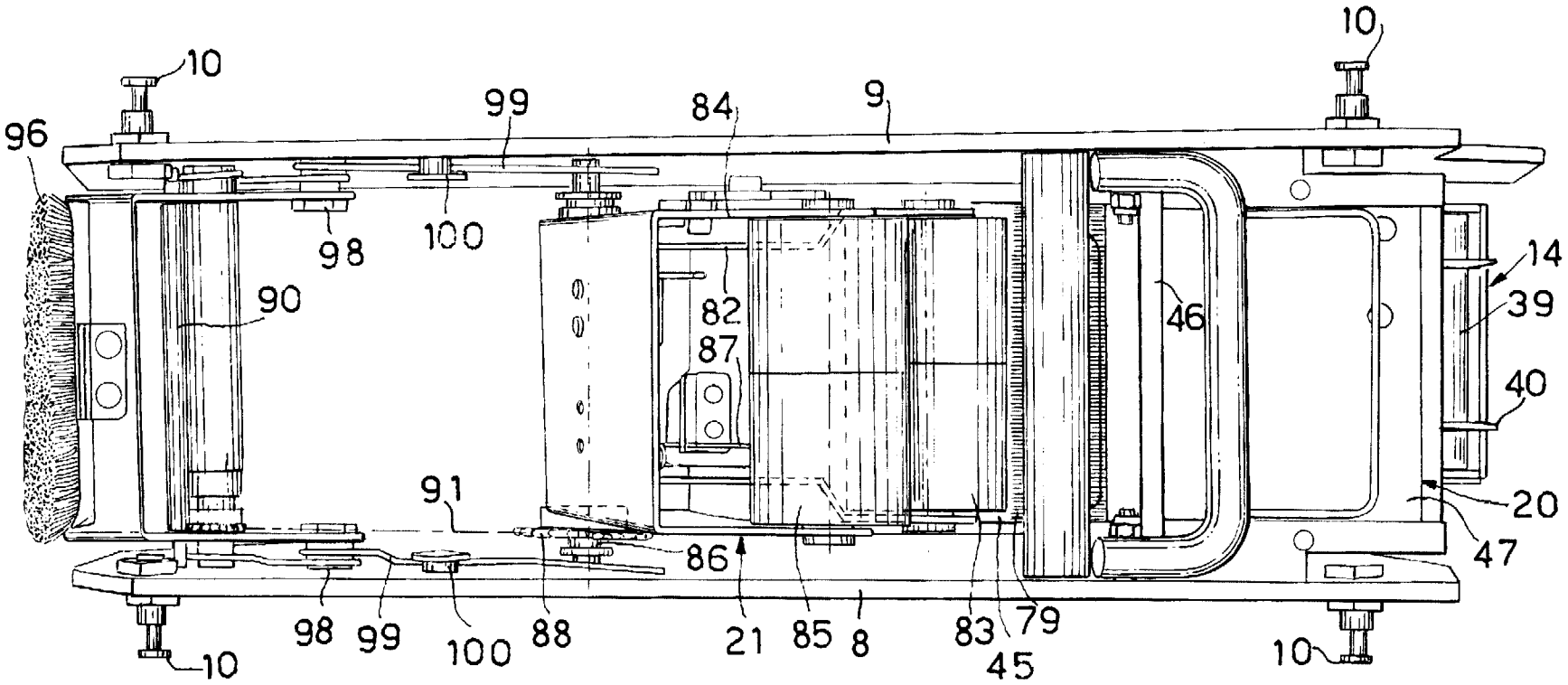
FIGS. 6–8 show the above-mentioned tape feed assembly in a plan view from below in different operating positions.

The unit 21 for the application of the moistened tape, shown in FIGS. 5–9, consists of a first lever 82 with an idle rubber roller 83, a second lever 84 with an idle rubber roller 85, a center of rotation 86 that is common for the two levers 82, 84 and a spring 87 which when at rest holds the levers 82, 84 in the close position shown in FIG. 6 and, with a continuous line, in FIG. 5.

A gear 88, integral with the lever 84 and rotatable together with it around the center of rotation 86, is connected to a toothed wheel 89 with center in 90 through a chain 91, to which there is fastened at 92 the stem of a pneumatic cylinder 93 hinged at 94 on the shoulders 8 and 9.

On the lever 82 there is mounted a pneumatic valve 95 operated by the lever 84 (FIG. 5).

In the position at rest the cylinder 93 is activated in extension so as to keep the levers 82 and 84 in the starting position as illustrated with a continuous line in FIG. 5 and also in FIG. 6.

Operated by the belts 2, the box 22 then acts on the roller 85 of the lever 84, causing a rotation of the latter sufficient for the deactivation of the valve 95, which disconnects air to the cylinder 93 so that the lever 84 thrust by the box can rotate about its center 86 to the final position illustrated with a dotted line in FIG. 5, overcoming only the thust of the spring 87.

Once the box has passed by completely, the lever 82 due to the effect of the spring 87 is connected again to the lever 84 reactivating the valve 95, which operates the extension of the cylinder 93, which acting on the chain 91 through the connection point 92 takes the levers 82, 84 back to the starting position.

With the tape application unit 21 there is associated a brush 96 for keeping the tape pressed up against the box 22, that is fastened to a lever support 97 hinged at 98 on the shoulders 8 and 9 and urged in the position shown in FIG. 5 by a spring 99 reacting against a fixed pin 100.

Between the shoulders 8 and 9 there is a support 101 on which various solenoid valves are mounted to operate the various pneumatic cylinders described above during the taping cycle. On the support 101 there are two pushbuttons 102 for the manual operation of both the forward movement of the gum-coated paper tape and the intervention of the shearing unit.

On the machine, in a position such as to be operated by the passage of the box, there are lastly two microswitches, of which the first operates the tape feed and the second operates the shear of the gum-coated paper tape.

From the structure described above, the following manner of operation of the machine illustrated in the drawings and, in general, of the machine according to the invention, is achieved.

If a roll of gum-coated paper 12 has been mounted on the roller 24 and the tape 31, after being threaded through all the rollers 28, 29, 30, 39, is made to slide between the two plates 15 and 16 until it protrudes from the chute 45 and down to the lower level (looking at FIG. 5) of the shoulders 8 and 9, after executing some manual operations of tape feed and shear by acting on the pushbuttons 102, the machine is ready to operate automatically.

When the box moves forward under the action of the belts 2, it presses a first microswitch, which by means of an associated solenoid valve operates the cylinder 49 so as to cause its stem to return to the position shown in FIG. 5. The return of the stem of the cylinder 49 operates the gears 51 and 53 and thus the wheel 54, which pushes toward the chute 45 the gum-coated tape through a length N (FIG. 5) predetermined by the screw 55.

Passing over the chute 45 the gum-coated paper tape comes into contact with the brush 79 which moistens the glue on the paper tape.

The tape that has come down in this way positions itself between the box moving forward and the roller 85 of the lever 84. Upon moving forward a little further, the box glues the edge of the tape protruding from the feed unit 6 on the front part of the same box, utilizing for this purpose the pressure exerted by the roller 85 due to the action of spring 87.

At this point the box also operates a second microswitch which, through a further solenoid valve, shuts air off from the cylinder 57, which due to the effect of the internal spring, retracts its stem and moves the wheel 61 away from the wheel 54 and thus leaves the gum-coated paper tape to move freely between the plates 15 and 16.

Figure 7:
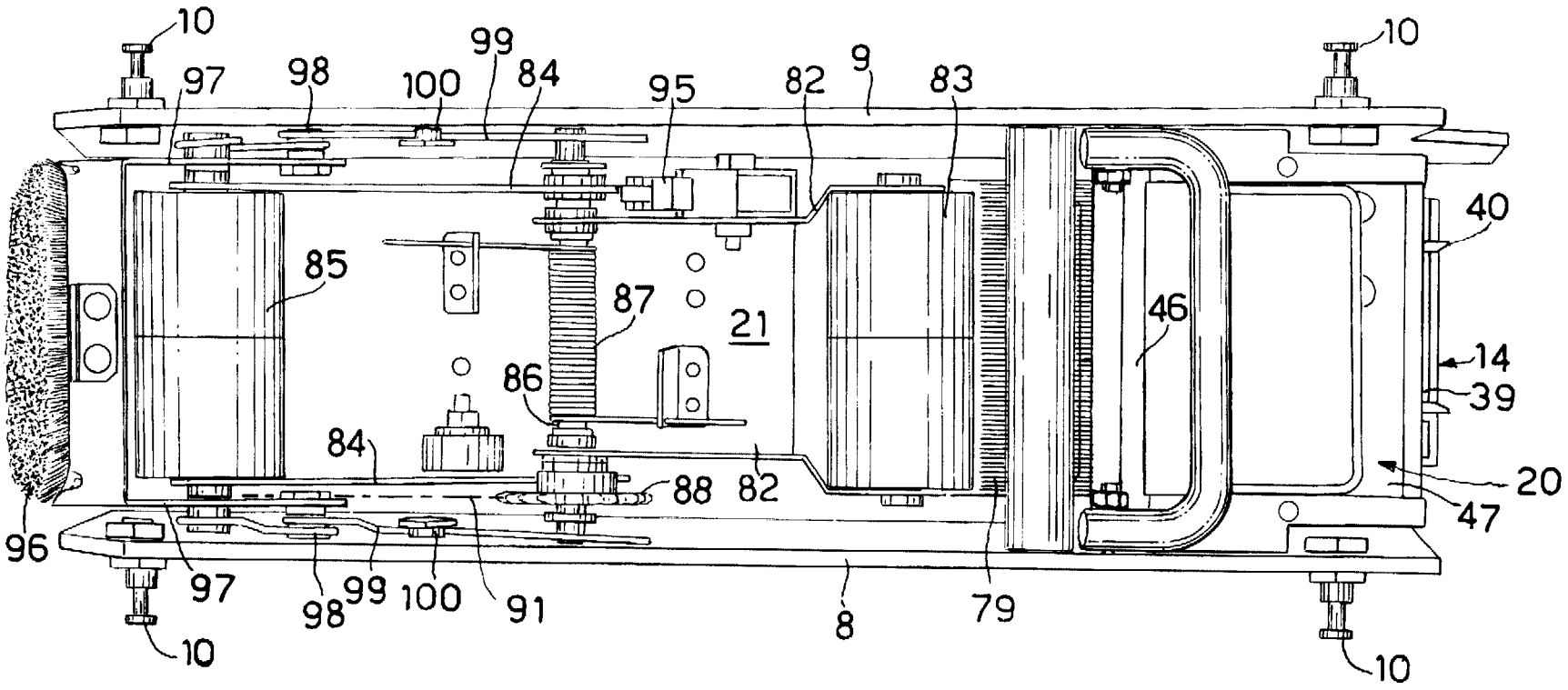

Continuing its forward movement, the box calls up all the tape that is necessary which, after being moistened by the brush 79, is pressed onto the box by the rollers 83 and 85 with the movements already described and illustrated in FIGS. 6 and 7.

When the box leaves the first microswitch, the corresponding solenoid valve operates in extension against the screw 55 the cylinder 49 which through the movement of the gears 51 and 53 returns the wheel 54 to the angular position at start.

When the box leaves the second microswitch, the corresponding solenoid valve operates in extension the cylinder 63, which through the lever mechanism 65 and 67 operates the blade 69 so as to cause it to shear, in co-operation with the counterblade 70, a section of gum-coated paper tape of a length sufficient for sealing the entire length of the box, plus short vertical sections at the end walls.

At the same time, through another solenoid valve, the cylinder 57 is operated in extension and this, through the levers 59, presses the wheel 61 against the wheel 54 and locks the gum-coated paper tape between the plates 15 and 16.

Figure 8:
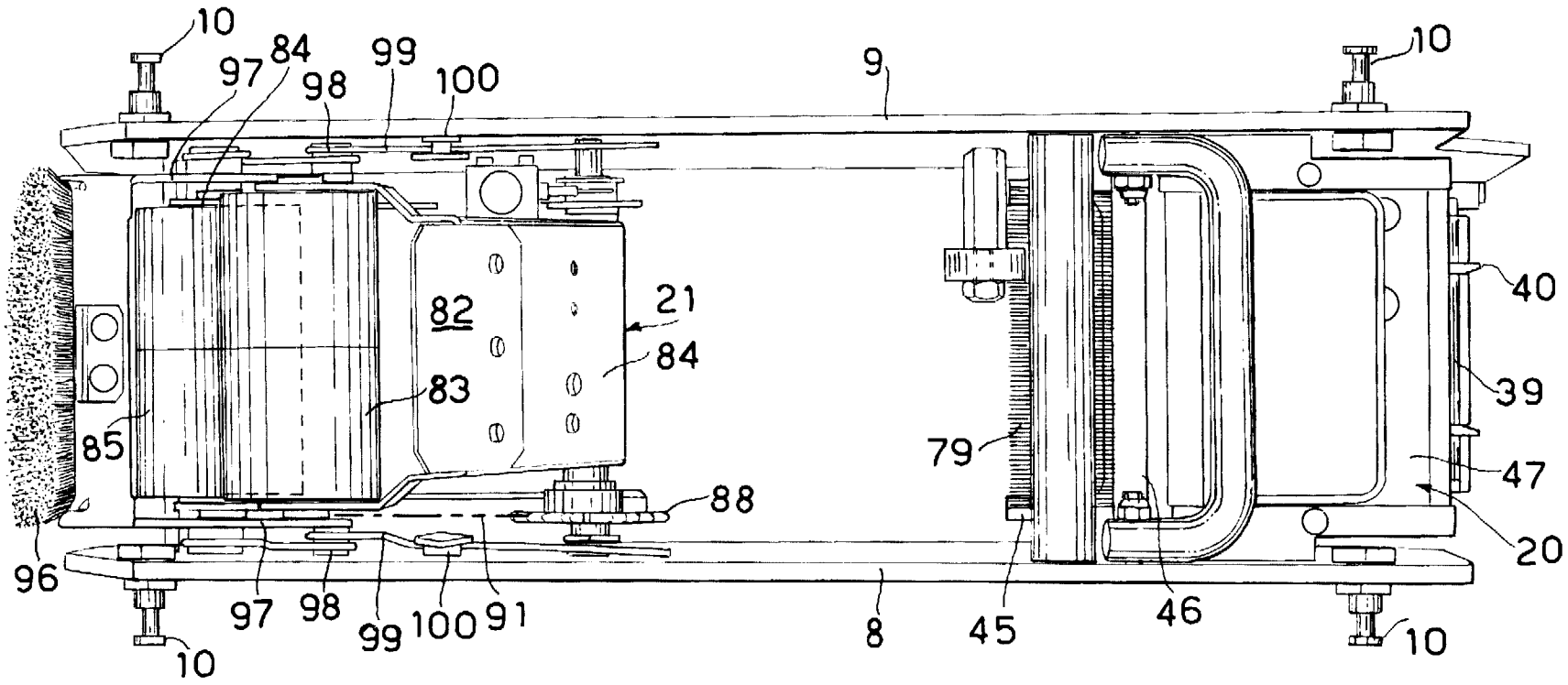

The rear edge of the gum-coated paper tape is applied to the rear part of the box by the roller 83, urged by the spring 87 in the position of FIG. 8.

When the box has left the brush 96 and the levers 83 and 85 have returned to the starting position, the feed unit is ready for a new cycle.

If after a time predetermined by means of a timer the cycle is not repeated, the cylinder 73 is operated to open the plate 15 (FIG. 4) leaving the tape free and thus avoiding a lengthy stop that, in the presence of moisture, could cause it to glue itself onto the plate 16.

When the moment comes for a new box to pass by with the consequent new operation of the first microswitch, the cylinder 73 shall be operated again and shall cause the new closing of the plates 15 and 16.

To better activate the glue on the paper tape it is possible to heat both the chute 45 and the water in the container 77, through the resistances 47 and 78 operated by a suitable themostat.

I claim:

1. A machine for sealing foldable flaps of parallelepiped boxes with gum-coated paper tape, comprising:

a supporting base adapted to support boxes to be sealed;

means for moving said boxes along said supporting base;

a head having a mounting seat and being vertically movable with respect to said supporting base; and at least one tape feed assembly constructed and arranged to apply sections of said gum-coated paper tape to said parallelepiped boxes and comprising a plurality of components including a unit for supporting a roll of gum-coated paper tape, a tape control unit, a tape centering unit, a tape feed unit, a contrast unit, a tape shearing unit, a tape moistening unit, and a unit for applying the moistened tape to said boxes, said tape feed assembly being i) removably mounted on said mounting seat of said vertically movable head and ii) disassembleable into its individual constituent components including said unit for supporting said roll of gum-coated paper tape, said tape control unit, said tape centering unit, said tape feed unit, said contrast unit, said tape shearing unit, said tape moistening unit, and said unit for applying the moistened tape to said boxes.

2. A machine according to claim 1, wherein said gum-coated paper tape travels in a predetermined path through said machine, and wherein said tape feed unit can be separated from the contrast unit so as to expose a major portion of the path upstream from said moistening and application units.

3. A machine according to claim 2, wherein said major portion of said path is defined by a pair of co-operating plates having openings for co-operating wheels which enable movement of said gum-coated paper tape through said machine.

4. A machine according to claim 1, wherein said tape feed unit comprises a pair of cooperable gears, a first of which is rotatably driven by a twin-action pneumatic cylinder and a second of which is mounted coaxially with and driven by said first gear, said second gear being integrally formed with a first wheel for moving and locking said gum-coated paper tape.

5. A machine according to claim 4, wherein said contrast unit comprises an idle wheel that can be displaced to engage said first wheel for enabling movement and locking of the gum-coated paper tape.

6. A machine according to claim 1, wherein said unit for applying the tape comprises first and second levers, each having respective idle rollers rotatably mounted thereon, and elastic means for maintaining said levers in a close-up position wherein said second lever engages each of said boxes so as to pressingly adhere said gum-coated paper tape to said boxes.

7. Machine according to claim 1, wherein said tape feed unit and said contrast unit define an inclined tape path which continues at said tape shearing unit and is connected through arcuate guides with a subsequent vertical path section arranged at said tape moistening unit and said tape applying unit.

* * * * *